US011889954B2

(12) United States Patent
Tebeau et al.

(10) Patent No.: US 11,889,954 B2
(45) Date of Patent: Feb. 6, 2024

(54) APPARATUS FOR DISPENSING CONSUMER GOODS

(71) Applicants: Michelle M. Tebeau, Cincinnati, OH (US); Steve L. Tebeau, Cincinnati, OH (US)

(72) Inventors: Michelle M. Tebeau, Cincinnati, OH (US); Steve L. Tebeau, Cincinnati, OH (US)

( * ) Notice: Subject to any disclaimer, the term of this patent is extended or adjusted under 35 U.S.C. 154(b) by 0 days.

(21) Appl. No.: 18/252,616

(22) PCT Filed: Nov. 17, 2021

(86) PCT No.: PCT/US2021/059651
§ 371 (c)(1),
(2) Date: May 11, 2023

(87) PCT Pub. No.: WO2022/115286
PCT Pub. Date: Jun. 2, 2022

(65) Prior Publication Data

US 2023/0329492 A1 Oct. 19, 2023

Related U.S. Application Data

(60) Provisional application No. 63/118,105, filed on Nov. 25, 2020.

(51) Int. Cl.
*A47K 10/22* (2006.01)
*A47K 10/38* (2006.01)

(52) U.S. Cl.
CPC ..... *A47K 10/22* (2013.01); *A47K 10/3836* (2013.01)

(58) Field of Classification Search
None
See application file for complete search history.

(56) References Cited

U.S. PATENT DOCUMENTS

| | | | | |
|---|---|---|---|---|
| 1,897,266 A | | 2/1933 | McGeoch et al. | |
| 2,470,030 A | * | 5/1949 | Habuda | A47K 10/32 242/596.8 |
| 2,499,815 A | * | 3/1950 | Carlin | D06M 15/41 242/596.8 |

(Continued)

FOREIGN PATENT DOCUMENTS

| | | |
|---|---|---|
| JP | 2017128341 A | 7/2017 |
| JP | 6515233 B1 | 5/2019 |
| RU | 2672633 C2 | 11/2018 |

OTHER PUBLICATIONS

International Search Report and Written Opinion from PCT/US2021/059651 dated Jan. 11, 2022.

*Primary Examiner* — William A. Rivera
(74) *Attorney, Agent, or Firm* — Calfee, Halter & Griswold LLP

(57) ABSTRACT

An apparatus comprises a base and an arm. The base has a first section defining an aperture through a thickness of the first section; a second section having a varying thickness along a width of the second section; and a third section, wherein the second section is between the first section and the third section. The arm is pivotally coupled to the second section and rotatable between a first position, in which the arm is positioned proximate the first section of the base, and a second section, in which the arm is positioned proximate the third section of the base.

18 Claims, 10 Drawing Sheets

(56) References Cited

U.S. PATENT DOCUMENTS

| | | | | |
|---|---|---|---|---|
| 2,903,199 | A * | 9/1959 | Gralewicz | A47K 10/40 242/597.5 |
| 3,087,662 | A | 4/1963 | Dresser | |
| 3,721,395 | A * | 3/1973 | Snipes | B60R 7/084 242/596.8 |
| 3,896,691 | A | 7/1975 | Granger et al. | |
| 4,858,840 | A | 8/1989 | Kidman | |
| 5,799,895 | A | 9/1998 | Michaud et al. | |
| 6,624,011 | B1 * | 9/2003 | Subramanian | H01L 27/0688 257/E27.026 |
| 6,685,075 | B1 * | 2/2004 | Kannankeril | B65H 35/10 225/96 |
| 6,824,031 | B2 * | 11/2004 | McKenzie | A45F 3/14 242/588.1 |
| 7,090,106 | B2 * | 8/2006 | Holden | A47K 10/3836 225/25 |
| 7,546,974 | B1 * | 6/2009 | Bailes | B60R 7/043 242/588 |
| 9,723,823 | B2 * | 8/2017 | Richardson | B65H 49/205 |
| 10,342,397 | B1 | 7/2019 | Rosenberg | |
| 10,506,900 | B1 * | 12/2019 | Pagliaro | B65H 16/005 |
| 2002/0033406 | A1 * | 3/2002 | Holden | A47K 10/38 225/96.5 |

* cited by examiner

APPARATUS FOR DISPENSING CONSUMER GOODS

CROSS-REFERENCE TO RELATED APPLICATIONS

This application is the U.S. national stage entry of PCT/US2021/059651, filed on Nov. 17, 2021, which claims priority to and all benefit of U.S. Provisional Patent Application No. 63/118,105, filed on Nov. 25, 2020, the contents of which are incorporated by reference herein in its entirety.

BACKGROUND

Field

The present disclosure relates to a dispenser for rolled, stacked or otherwise dispensable goods that can be transported in a vehicle and stowed under a seat or in a cargo area.

TECHNICAL BACKGROUND

Passengers in vehicles experience food/drink spills, dirty or foggy windshields, and messes in general. Although the use of paper towels or other consumer paper goods are useful in cleaning up such messes, finding a place to stow and dispense the paper towels in a vehicle without giving up precious cabin space and having them unravel freely during transit is a challenge.

Accordingly, there is a need for improved dispensers for paper goods, and particularly, dispensers suitable for use in a vehicle.

SUMMARY

According to one embodiment, an apparatus comprises a base and an arm. The base has a first section defining an aperture through a thickness of the first section; a second section having a varying thickness along a width of the second section; and a third section, wherein the second section is between the first section and the third section. The arm is pivotally coupled to the second section and rotatable between a first position, in which the arm is positioned proximate the first section of the base, and a second position, in which the arm is positioned proximate the third section of the base.

Additional features and advantages will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
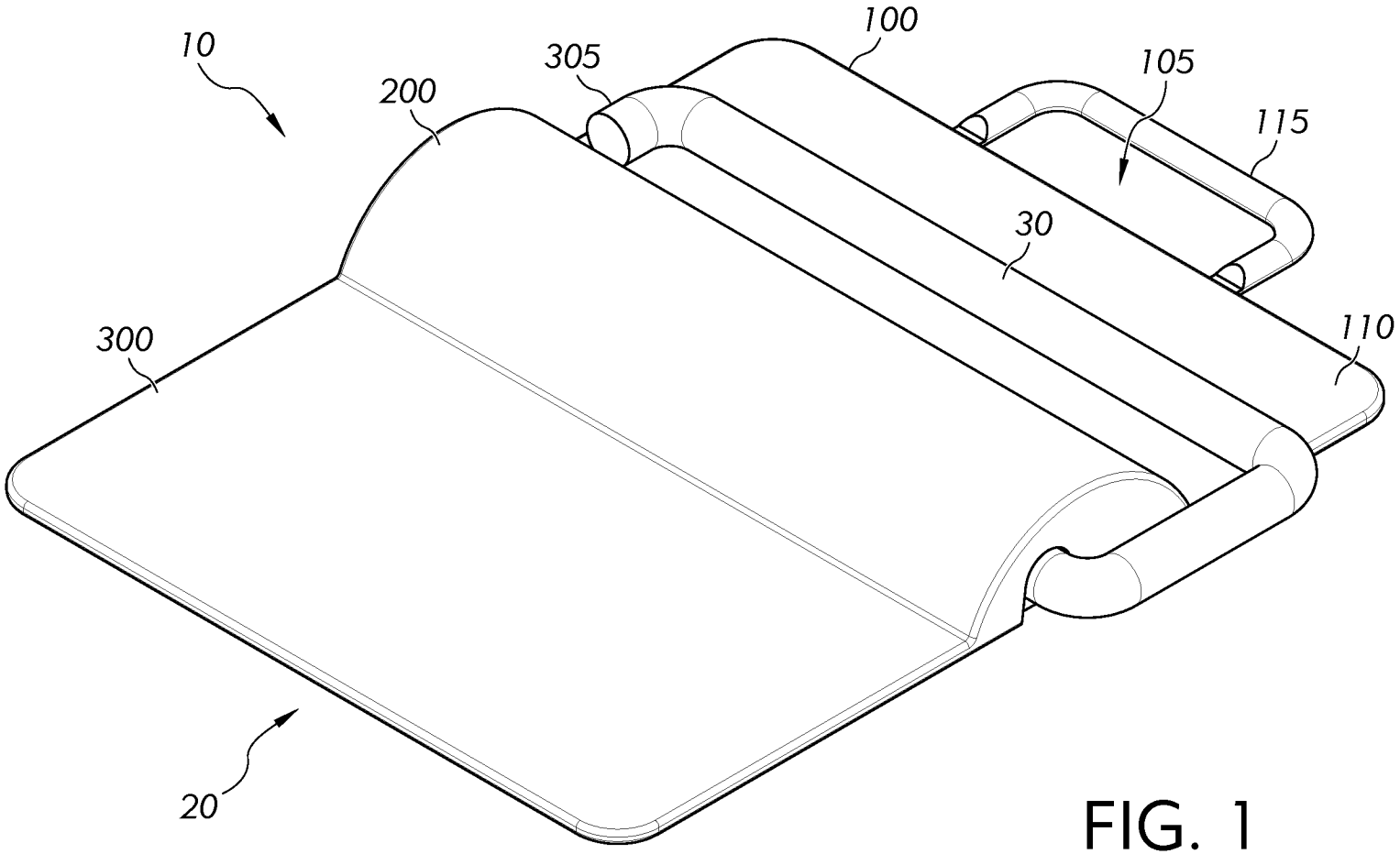
FIG. 1 is a perspective view of an embodiment of a dispenser having an arm in a first position according to one or more embodiments shown and described herein.

Reference will now be made in detail to various embodiments, examples of which are illustrated in the accompanying drawings. Whenever possible, the same reference numerals will be used throughout the drawings to refer to the same or like parts. One embodiment of the apparatus is shown in FIGS. 1 and 2, and is designated generally throughout by the reference numeral 10.

In the following detailed description, the apparatus 10 is configured to dispense paper, plastic, and disposable products. In various embodiments described herein, the apparatus 10 includes a base 20 that enables the apparatus 10 to be positioned within a vehicle and maintained in position by friction forces, while enabling the product to be dispensed. Additionally, the base 20 secures the product in position through friction forces during movement of the vehicle, thereby preventing the product from unraveling or rolling around in the vehicle. It should be noted that although only a dispenser of rolled paper goods (e.g., paper towels) is described herein, it is contemplated that the apparatus can also be used in to dispense other paper, plastic, or disposable goods such as facial tissues, napkins, plastic bags, and other goods offering access to a base that nests in your vehicle main cabin or cargo cabin, which can also be transported via a handle and function vertically.

Figure 2:
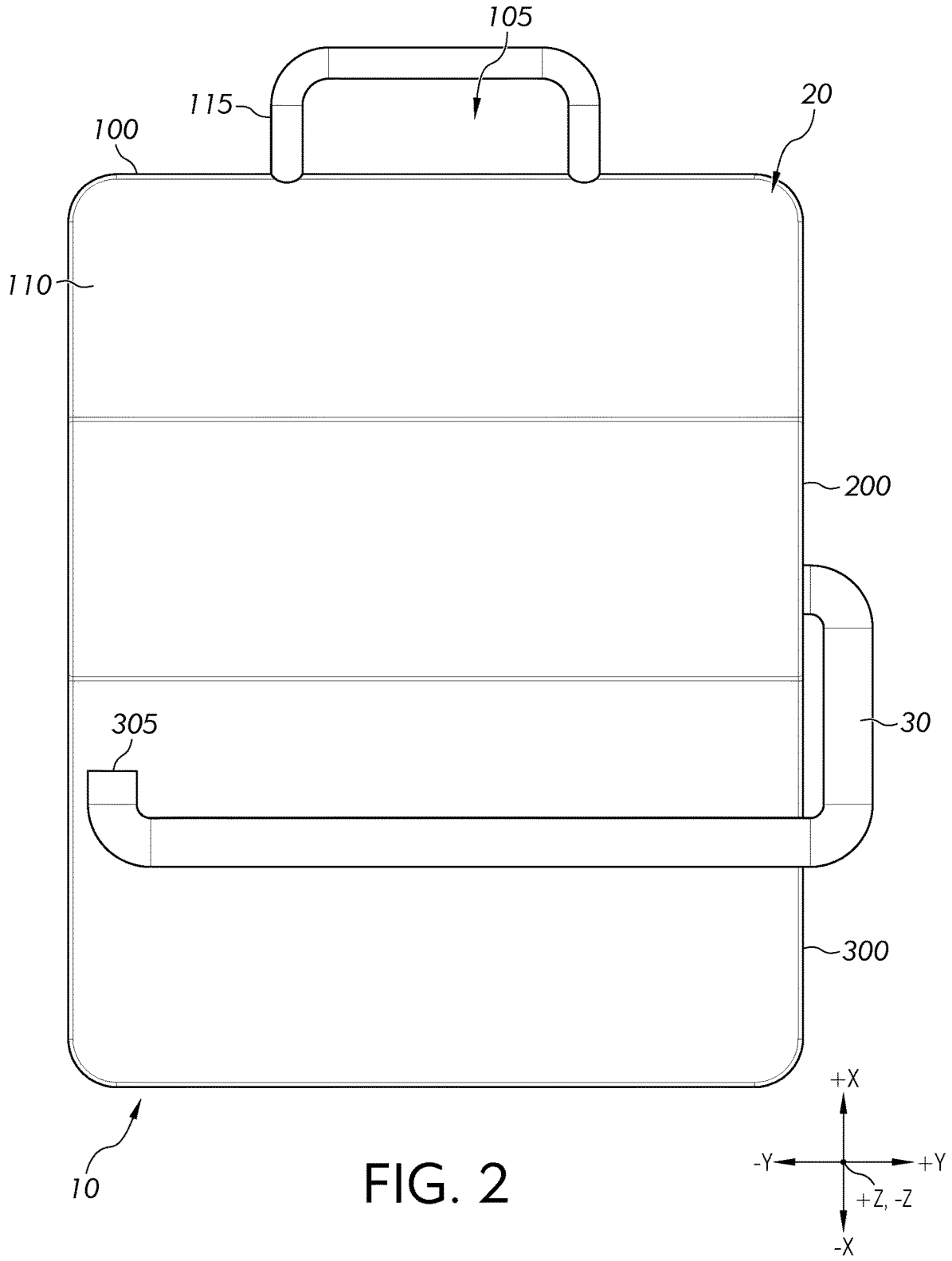
FIG. 2 is a top view of the embodiment of the dispenser of FIG. 1 and having the arm rotated into a second position according to one or more embodiments shown and described herein.
Figure 3:
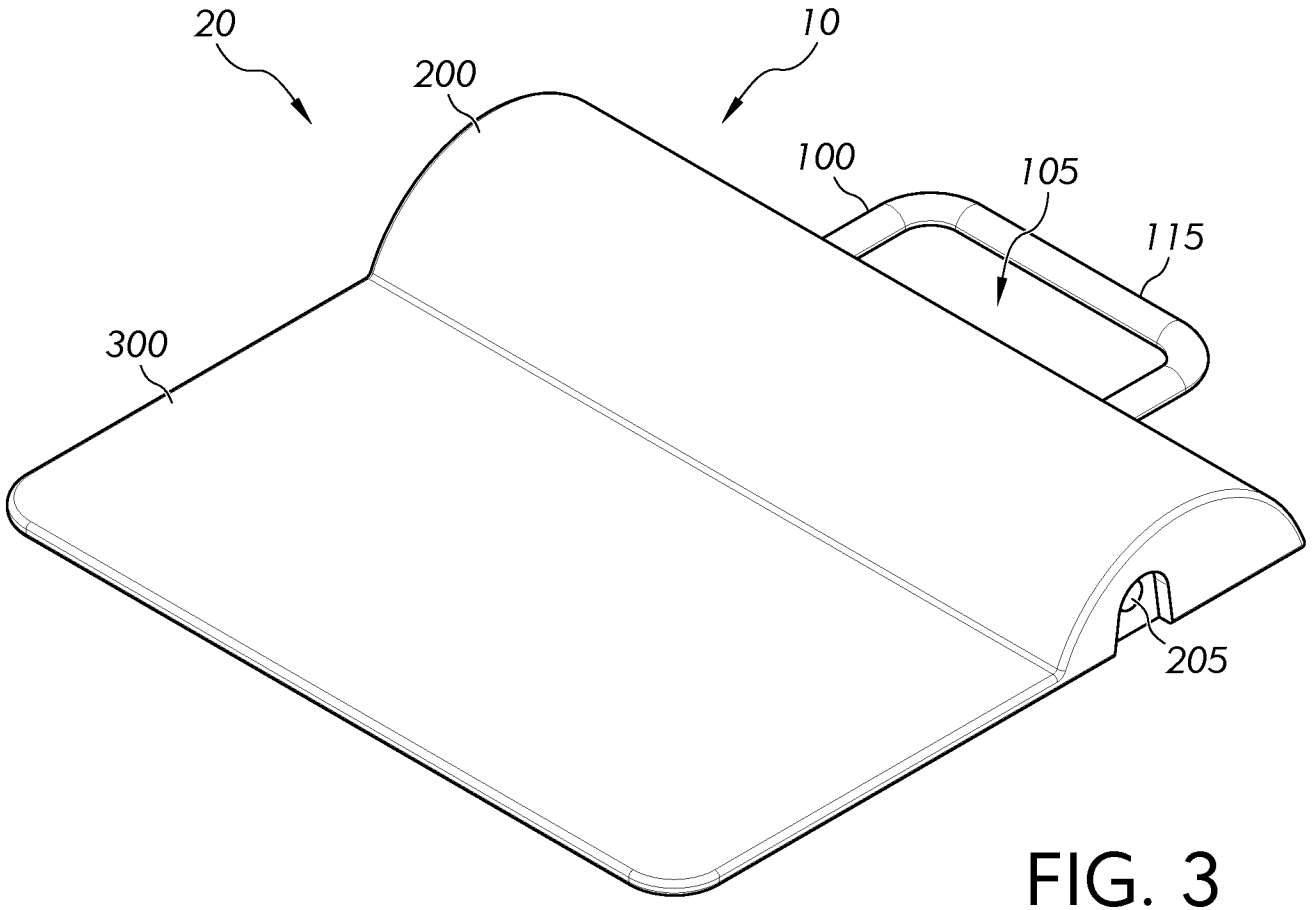
FIG. 3 is a perspective view of another embodiment of a dispenser according to one or more embodiments shown and described herein.
Figure 4:
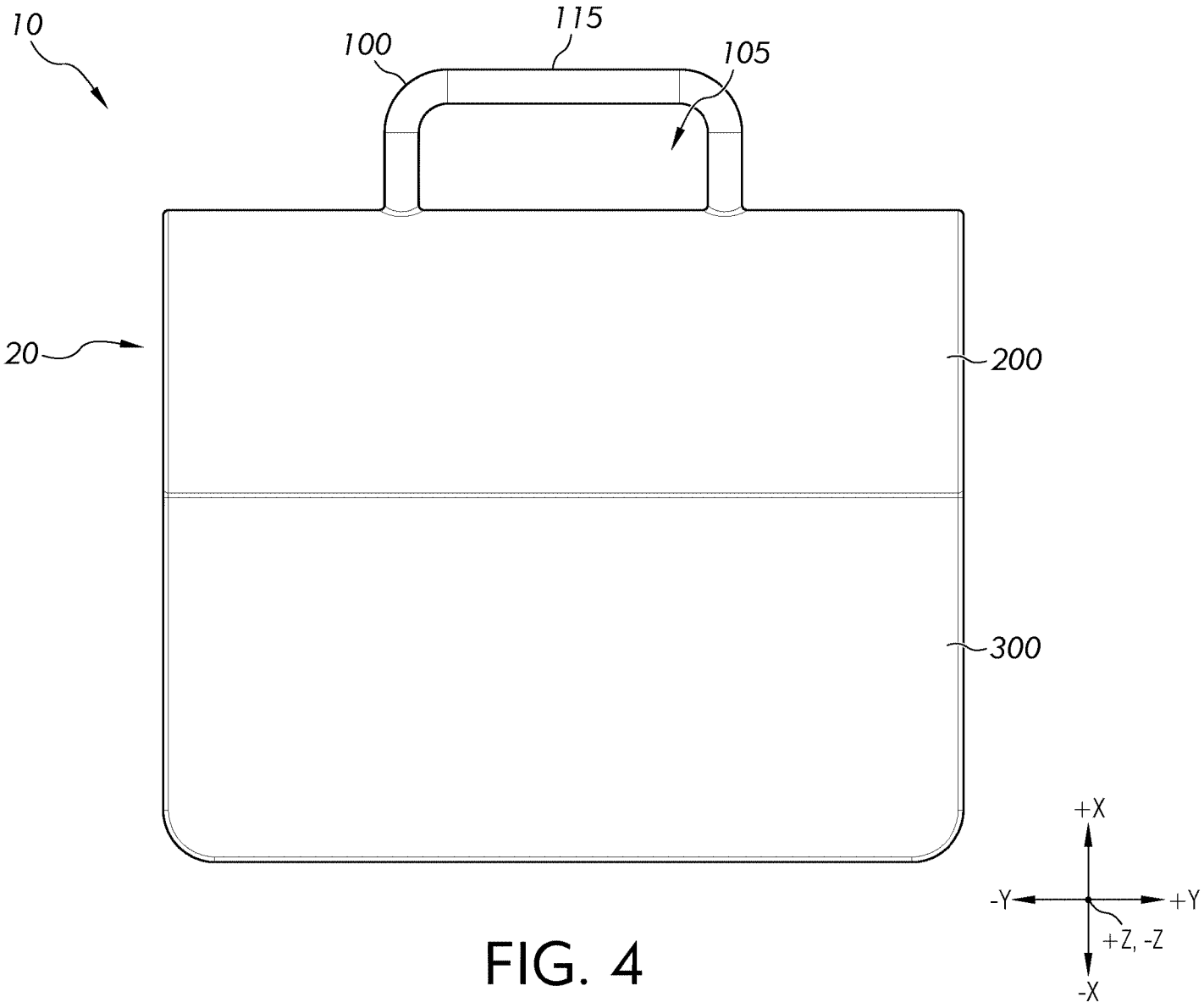
FIG. 4 is a top view of the embodiment of the dispenser of FIG. 3 according to one or more embodiments shown and described herein.
Figure 8:
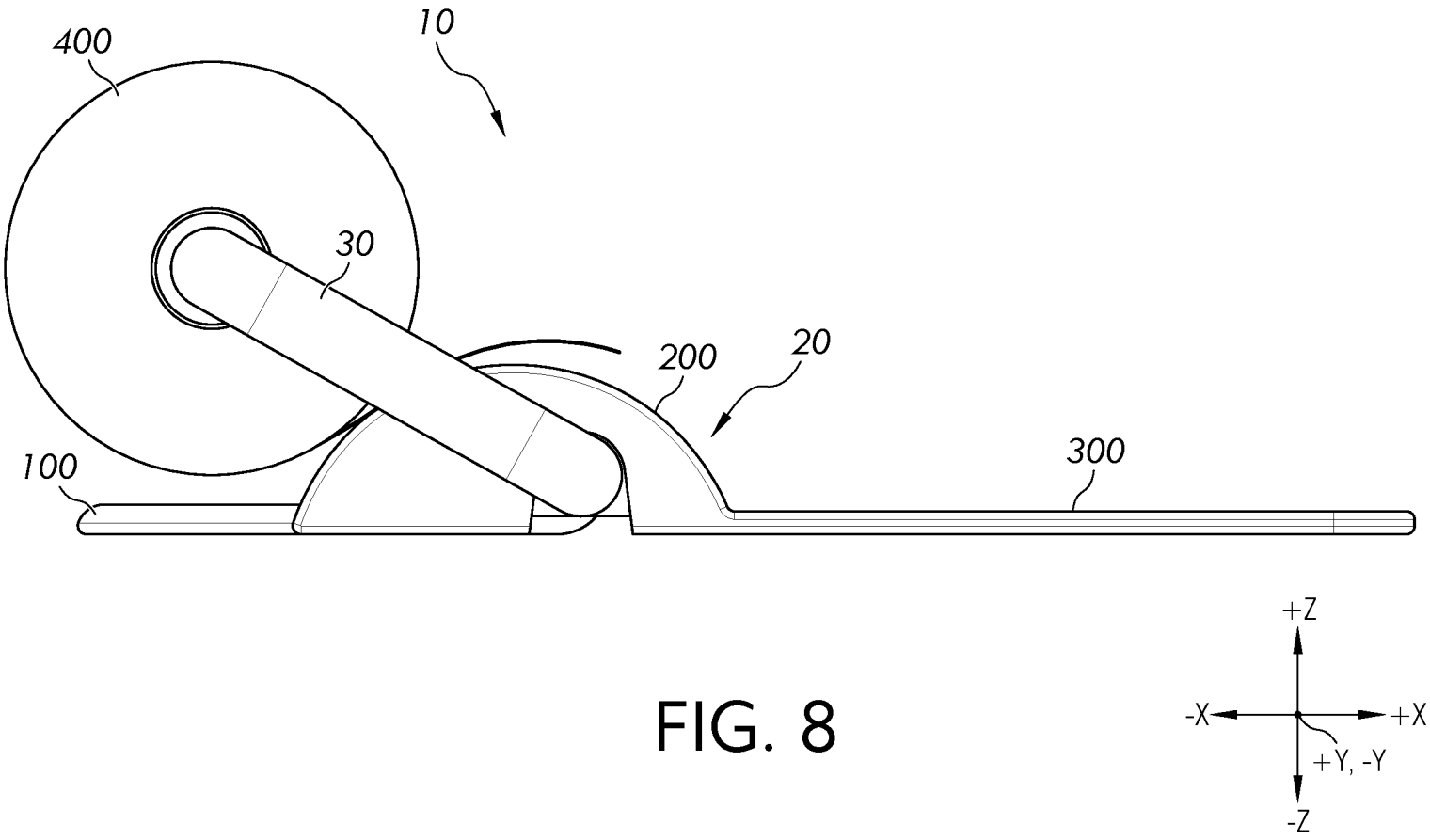
FIG. 8 is a side view of an embodiment of a dispenser including a roll of paper towels according to one or more embodiments shown and described herein.

As shown in FIGS. 1 and 2, the apparatus 10 includes a base 20 having three sections including a first section 100, a second section 200, and a third section 300. The first section 100 defines an aperture 105 through a thickness of the first section 100 (e.g., the aperture extends from between a top surface and a bottom surface of the first section 100). In embodiments, the first section 100 forms or includes a handle 115. In embodiments, the aperture 105 can be rectangular in shape, as shown in the FIGS., although it is contemplated that the first section 100 can define apertures having other shapes. In embodiments, at least a portion of the first section has a circular cross-section. For example, in embodiments, the handle 115 has a circular or semi-circular cross-section when taken along the XZ plane, where Z is into and out of the page and X is shown in FIG. 2, although other cross-sections are contemplated and possible. In embodiments, in addition to providing defining a handle, the first section 100 can function as a cradle for dispensable products, a friction point, and/or a portability mechanism for transporting the apparatus. In embodiments, the first section 100 has a width in the X direction of from about 3 to about 8 inches, a length in the Y direction of from about 6 to about 10 inches, and a thickness in the Z direction (e.g., into and out of the page) of from about 0.5 to about 3 inches. In embodiments, the first section 100 can have a width from about 4.5 to about 7.5 inches, or from about 5 to about 6 inches. In embodiments, the first section 100 has a width that is less than about 6 inches. In embodiments, the first section 100 can have a length of from about 7 to about 9 inches, or from about 7.5 to about 8.5 inches. In embodiments, the first section 100 has a length that is less than about 8.5 inches. In embodiments, the first section 100 can have a thickness of about 0.5 inches to about 1.5 inches. In some embodiments, the first section 100 is variable in length. In other words, in some embodiments, the length of the first section 100 can vary over the width of the first section 100, as shown in FIGS. 1 and 2. However, in other embodiments, such as the embodiment shown in FIGS. 3 and 4, the length of the first section 100 can be constant. In embodiments in which the length of the first section 100 varies over the width, a portion 110 of the first section 100 can be substantially equal to a length of the second section 200 and/or the third section 300, as shown in FIGS. 1 and 2. In such embodiments, the portion 110 of the first section 100 forms a support surface for the product (not shown in FIGS. 1 and 2). However, when the portion 110 is not included, the handle 115 can support the product, as illustrated in FIG. 8.

In embodiments, the apparatus 10 can be mounted vertically using the handle 115. For example, the handle 115 of the first section can be coupled to a hook, handle, pin, or the like (not shown) through the aperture 105 to hang the apparatus 10 vertically. When in use vertically, the arm 30 is in the second position (shown in FIG. 2), with the roll of paper towels (not shown in FIGS. 1 and 2) in friction contact with the third section 300 of the base. In this configuration, the apparatus 10 functions much like a conventional paper towel dispenser, and enables users to pull the end of the roll of paper towels to dispense the product. Such a configuration may be useful, for example, during a picnic, camping, or the like.

In various embodiments, the second section 200 of the base 20 is in the form of a semi-circular hump. Although depicted in the figures as being semi-circular in shape, it is contemplated that, in embodiments, the second section 200 can have a different shape, such as a square, rectangle, or triangle. Other cross-sectional shapes are contemplated and possible, provided that they provide a surface against which the product rests when positioned against the base 20 and to apply a friction force to the product. In embodiments, the second section 200 may also provide protection from ambient environmental conditions, in particular moisture and soil.

Figure 5:
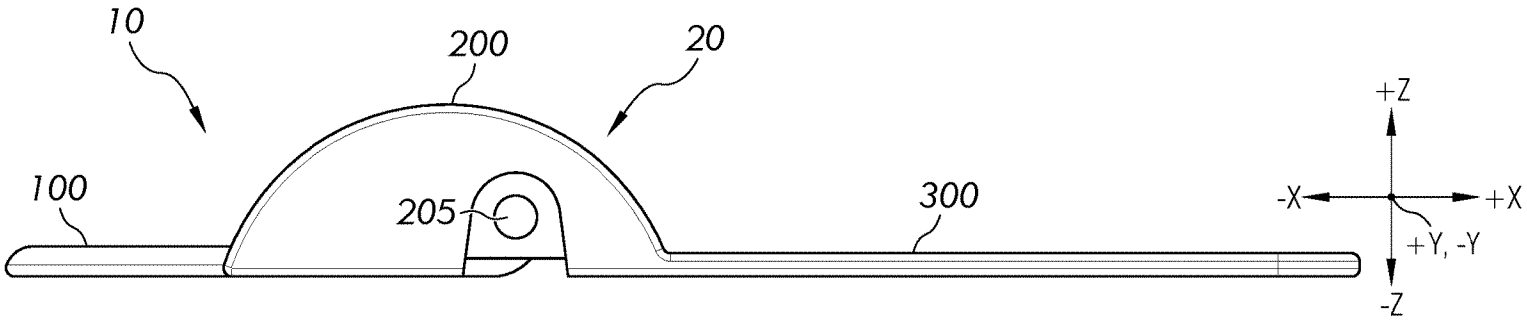
FIG. 5 is a side view of the embodiment of the dispenser of FIGS. 3 and 4 according to one or more embodiments shown and described herein.

Depending on the shape of the cross-section of the second section 200, the second section 200 can vary in thickness (in the Z direction as illustrated in FIG. 5) from a minimum thickness of about 0.125 inches to a maximum thickness of about 5 inches along a width (in the X direction) of the second section 200. In embodiments, the second section 200 has a first thickness at a first side of the second section (adjacent to the first section), a second thickness at a center point of a width of the second section, and a third thickness at a second side of the second section (adjacent to the third section). In embodiments, the first thickness and the third thickness are each less than a maximum thickness of the second section. In embodiments, the first thickness is substantially equal to the third thickness. In embodiments, the first thickness, the second thickness, or both, is a minimum thickness of the second section. In embodiments, the second thickness is a maximum thickness of the second section. In embodiments, the thickness of the second section increases from a first thickness to a second thickness and decreases from the second thickness to a third thickness over the length of the second section, wherein the first thickness is approximately equal to the third thickness.

In embodiments, the maximum thickness of the second section 200 can be about 5 inches, about 4 inches, about 3 inches, about 2.5 inches, about 2.25 inches, about 2.0 inches, about 1.75 inches, about 1.5 inches, or about 1.25 inches. For example, in embodiments, the thickness of the second section 200 increases from a thickness of 0.125 inches at a first side of the second section (adjacent to the first section 100) to a maximum thickness of about 1.5 inches at a center point along the width, and then decreases from the maximum thickness to a thickness of 0.125 inches to a second side of the second section (adjacent the third section 300), along the width of the second section. It is contemplated that the minimum and maximum thicknesses can vary depending on the particular embodiment. However, the maximum thickness should be less than a distance between the floor and the bottom surface of a seat in a vehicle in which the apparatus 10 is intended for use, while keeping the dispensable products relatively hidden from full view.

The second section 200 has a width along the X direction of from about 2 inches to about 6 inches, or from about 3 inches to about 5 inches. In embodiments, the second section 200 has a length along the Y direction of from about 6 inches to about 15 inches, or from about 8 inches to about 12 inches. It is contemplated that length and width of the second section 200 can vary depending on the particular embodiment. However, the dimensions should be less than the dimensions of a seat in a vehicle in which the apparatus 10 is intended for use. In embodiments, the second section 200 is positioned between the first section 100 and the third section 300 of the base along a width (e.g., the +/−X direction in the FIGS.) of the base 20, as illustrated in the FIGS.

The third section 300 of the base 20 is comprised of a non-slip material, such as rubber, plastic, or fabric. The third section 300 of the base 20 can serve, in various embodiments, as an anchor for the apparatus 10. For example, the third section 300 can be positioned to secure the apparatus 10 in place, such as by positioning the third section 300 under a floor mat, between a console of a vehicle and an adjacent seat, in a seat back pocket, or between the upright and seat portion of a seat of a vehicle. It should be appreciated that other positions and locations are contemplated and possible.

In embodiments, the third section has a thickness of less than about 1.5 inches, less than about 1 inch, less than about ¾ inch, less than about ½ inch, or the like. In embodiments, the third section 300 has a thickness of about 0.125 inches. In embodiments, the thickness enables the third section 300 to be positioned between a floor of a vehicle and a vehicle mat. In embodiments, the thickness of the third section 300 is selected such that the section can be cut through the thickness using scissors or a utility knife. The third section 300 has a width along the X direction of from about 2 inches to about 6 inches, or from about 3 inches to about 5 inches. In embodiments, the third section 300 has a length along the Y direction of from about 6 inches to about 15 inches, or from about 8 inches to about 12 inches. It is contemplated that length and width of the third section 300 can vary depending on the particular embodiment. In embodiments, the length of the third section 300 is substantially equal to the length of the second section 200. In some embodiments, the third section 300 can include perforations or indicia (not shown) to guide a user in cutting the width of the third section 300 to a desired dimension. The perforations or indicia can be in the form of, for example, a series of lines extending in the Y direction that are parallel to one another and perpendicular to a edge of the second section extending in the X direction. Although the third section 300 is depicted in the figures as being substantially rectangular in shape, it should be understood that other shapes are contemplated and possible.

As shown in FIGS. 1 and 2, the apparatus 10 further includes an arm 30 that is pivotally coupled to the second section 200 of the base 20. The arm 30 is rotatable between a first position, shown in FIG. 1, and a second position, shown in FIG. 2. In the first position, the arm is positioned proximate the first section 100 of the base 20, and in the second position, the arm is positioned proximate the third section 300 of the base 20. The arm 30 is received by the second section 200 of the base 20 is shaped to extend over and substantially parallel to the second section 200. In embodiments, the arm 30 has a length that is substantially equal to the length of the second section 200, although it is contemplated that the arm 30 can be longer or shorter than the length of the second section 200. The arm 30 can have a circular cross-section in various embodiments, to enable the rolled product to easily rotate when in place on the arm 30. Alternatively, the arm 30 can have a U-shaped cross-section, or another cross-section that includes one or more curves to enable a tube around which the product is rolled to rotate smoothly along the surface of the arm 30. Accordingly, in embodiments, the arm 30 has a diameter (or maximum cross-sectional dimension when the cross-section is not circular) that is less than about 4 inches, less than about 3 inches, or less than about 2 inches. Other diameters are contemplated and possible, provided that the diameter is large enough to provide adequate support for the product and small enough to fit within an aperture on a roll about which the product is wound.

Figure 6:
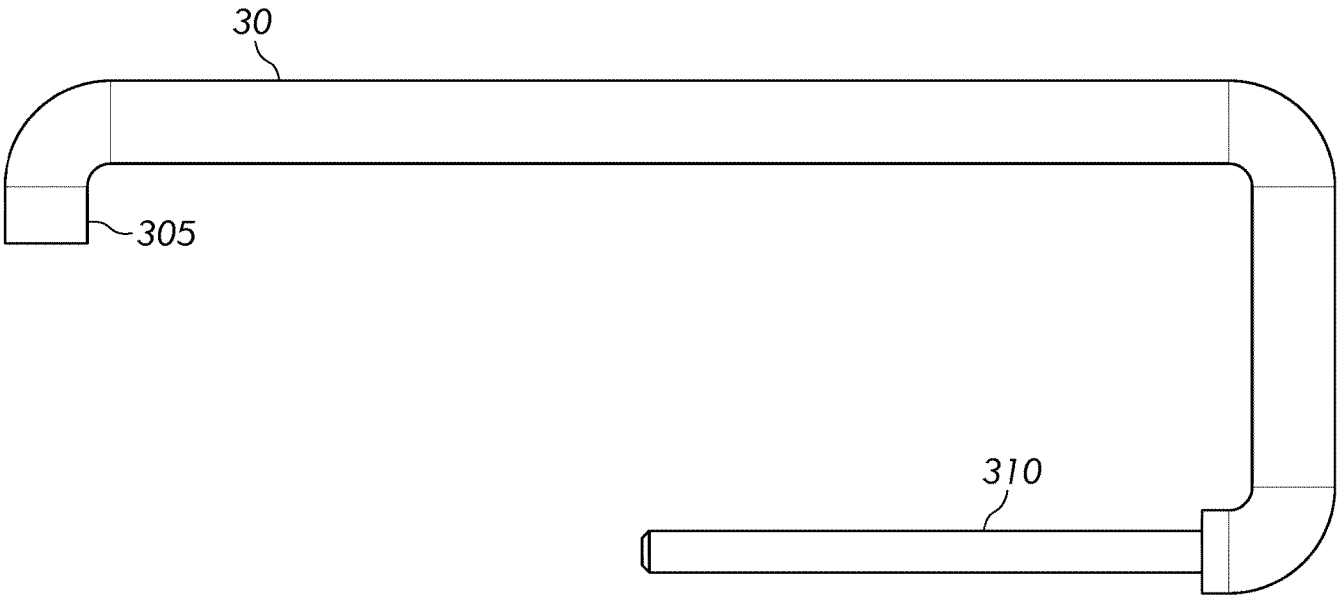
FIG. 6 is an illustration of a rotatable arm according to one or more embodiments shown and described herein.

As shown in FIG. 6, the arm 30 includes a number of curves. However, the arm 30 can take any one of a variety of forms, including forms that include straight edges and right angles.

To receive the arm 30, in embodiments, the second section 200 can have a female receiver 205 (shown in FIGS. 3 and 5) that is of a size and shape to mate with a male connector 310 (shown in FIG. 6) positioned at an end of the arm 30 and secure the arm 30 in place. It is contemplated that the female receiver 205 of the second section 200 can extend through the second section 200 along the length of the second section 200 (e.g., a tube extending from a first end of the second section to a second end of the second section), or can be positioned proximate one end of the second section 200. In the embodiments shown in the figures, the arm 30 is pivotally coupled to the second section 200 at one end through the male connector 310, which enables the product to be loaded onto the arm 30 in a fairly easy manner (e.g., by sliding the product onto the arm 30 from the uncoupled end of the arm 30. In the embodiment shown in FIGS. 1, 2, and 6, the arm 30 includes a lip 305 which retains the product in place when it is received by the arm 30. However, it is contemplated that in other embodiments, the arm 30 can be coupled to the second section 200 at both ends. In such embodiments, the product can be loaded onto the arm 30 by decoupling one or both ends of the arm 30 from the second section 200.

In embodiments, the arm 30 pivots around a rotational point at which the arm 30 is coupled to the second section 200 (e.g., a central point of the male connector 310). For example, the arm 30 can pivot about 1800 around the rotational point, about 1700 around the rotational point, about 1500 around the rotational point, about 1300 around the rotational point, about 1000 around the rotational point, or about 900 around the rotational point. In embodiments, rotation of the arm about the rotational point can be limited by, for example, the first section 100 and the third section 300 of the base 20, the thickness of the product, or by an angle limiter (not shown) that limits the angle of rotation of the arm.

Figure 7:
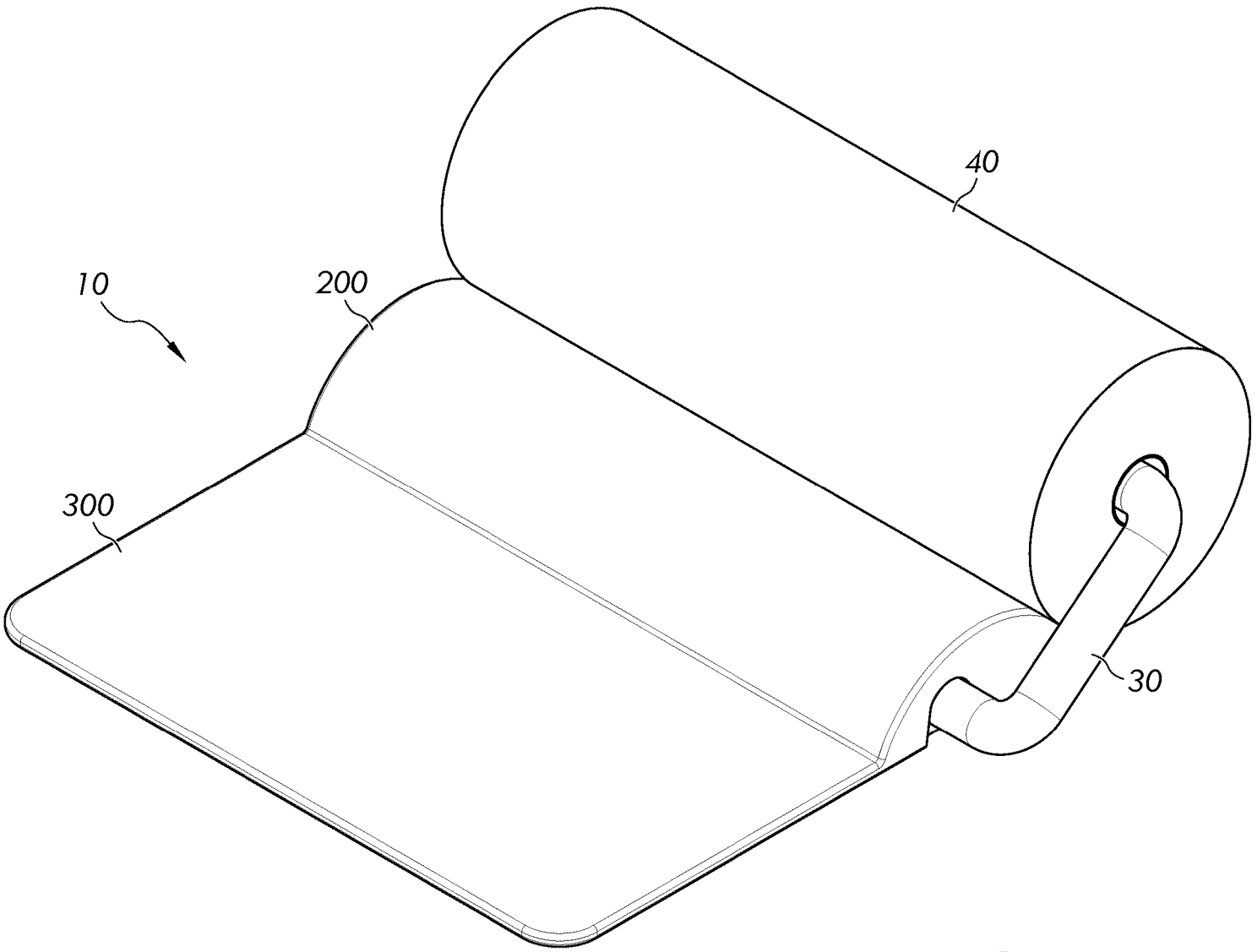
FIG. 7 a perspective view of an embodiment of a dispenser including a roll of paper towels according to one or more embodiments shown and described herein.

FIGS. 7 and 8 illustrates an embodiment of the apparatus 10 including a roll of paper towels 40 loaded onto the arm 30. As shown in FIG. 7, when the arm 30 is in the first position, the roll of paper towels 40 is supported by the first section 100, and is in friction contact with the second section 200 of the base 20. The second section 200 applies friction forces to the roll of paper towels 40, which prevents the roll of paper towels 40 from rotating around the arm 30 and unraveling.

As shown in FIG. 8, an end of the roll of paper towels 40 can be pulled over the second section 200 of the base 20. Accordingly, a user can pull the end of the roll of paper towels 40 to overcome the friction forces applied to the roll of paper towels 40 by the second section 200 and dispense the product. Thus, when the apparatus is positioned beneath a vehicle seat, the roll of paper towels 40 remains beneath the vehicle seat, but can be dispensed as needed by the user.

Figure 9:
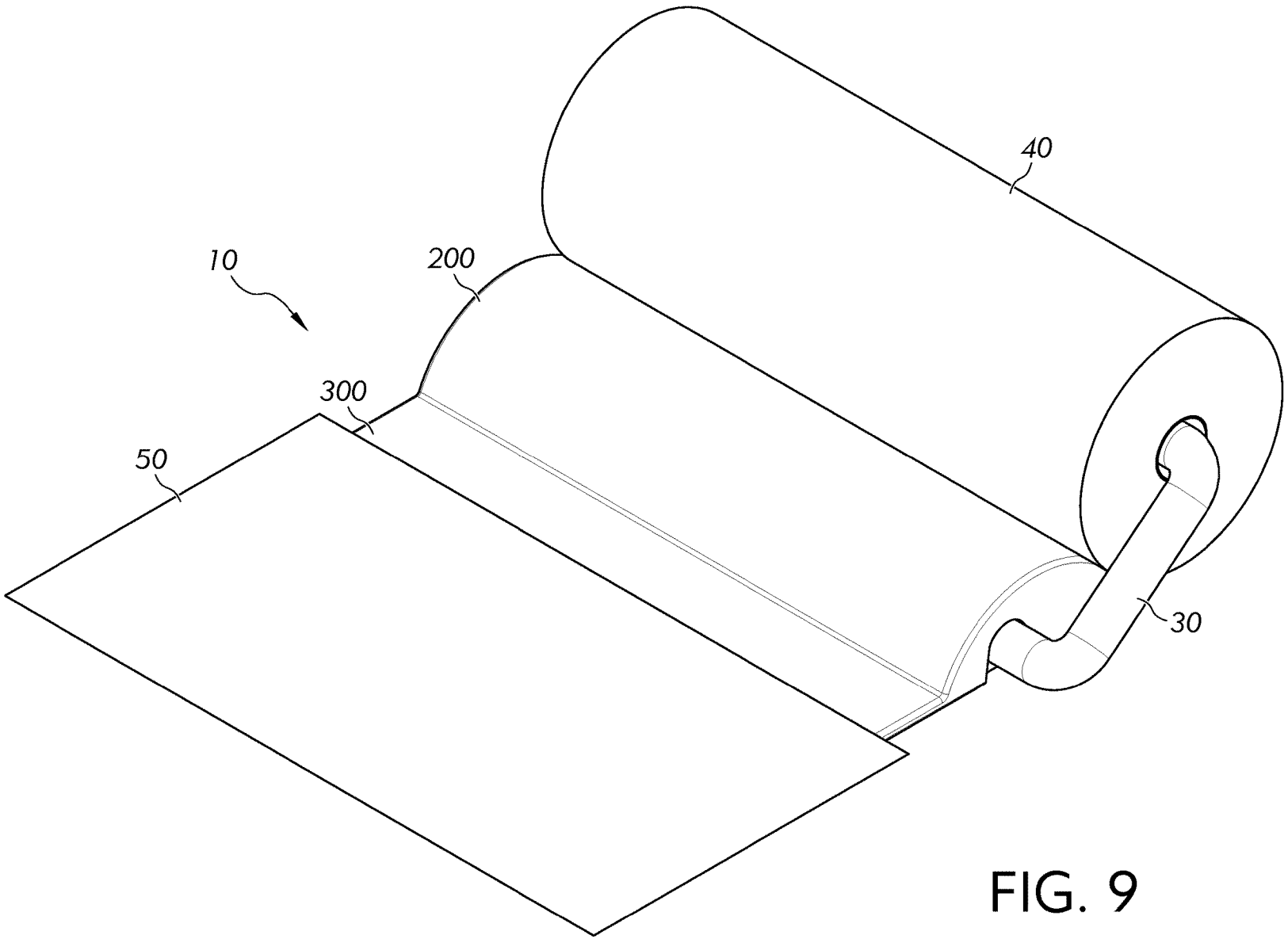
FIG. 9 is a perspective view of an embodiment of a dispenser including a roll of paper towels positioned under a floor mat according to one or more embodiments shown and described herein.

FIG. 9 illustrates the apparatus 10 as intended for use. In particular, FIG. 9 depicts the third section 300 of the base being positioned below a floor mat 50, such as a floor mat of a vehicle. In FIG. 9, the floor mat 50 rests on top of the third section 300, and friction forces between the third section 300 and the floor mat 50 maintain the apparatus 10 in position.

In FIG. 9, the arm 30 is in the first position. However, the arm 30 can be rotated to the second position (illustrated in FIG. 2) such that the roll of paper towels 40 are supported by the third section 300 of the base 20. In embodiments, the arm 30 can be moved into the second position to enable greater access to the roll of paper towels 40, or to enable the roll to be removed or replaced.

Figure 9B:
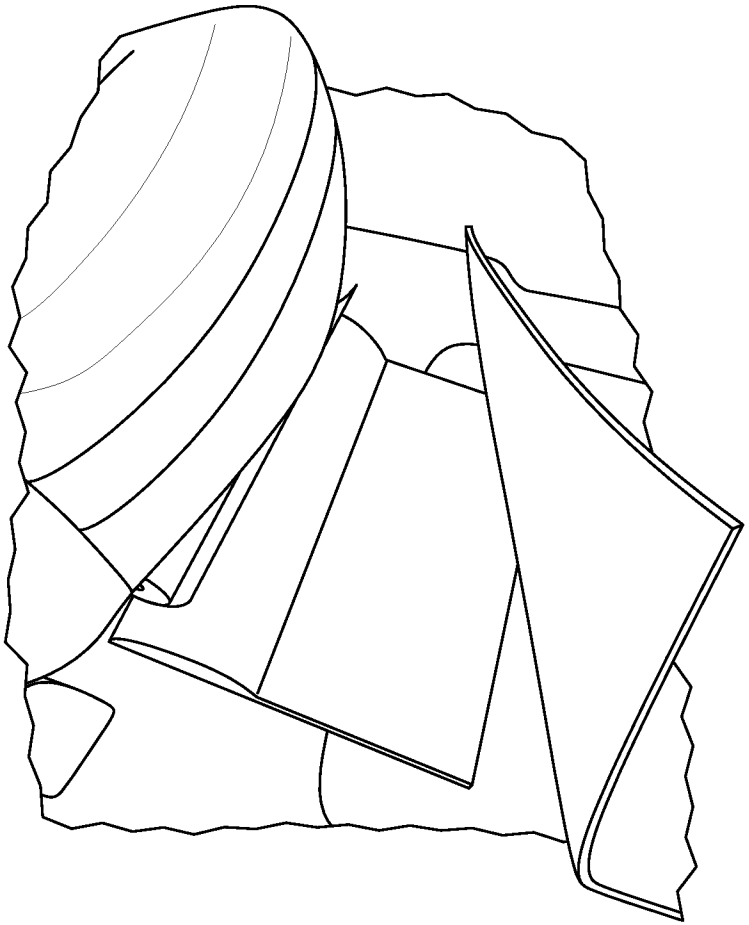
FIG. 9B is a photograph of a dispenser positioned within a vehicle according to one or more embodiments shown and described herein.
Figure 9A:
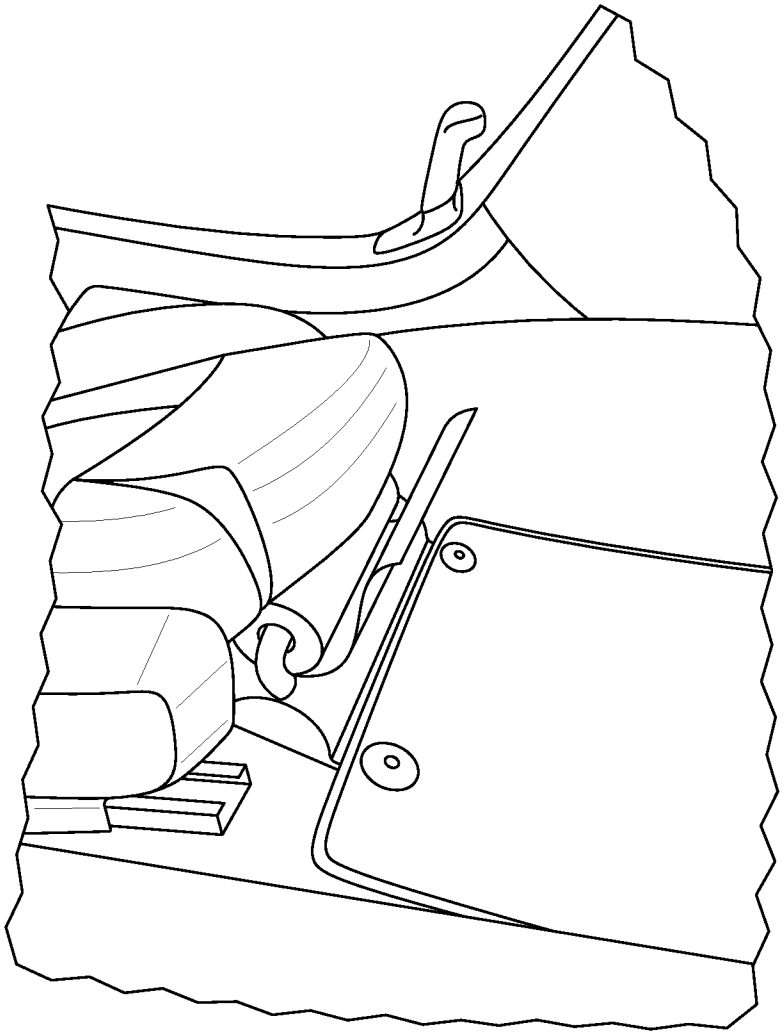
FIG. 9A is a photograph of a dispenser in use according to one or more embodiments shown and described herein.
Figure 9D:
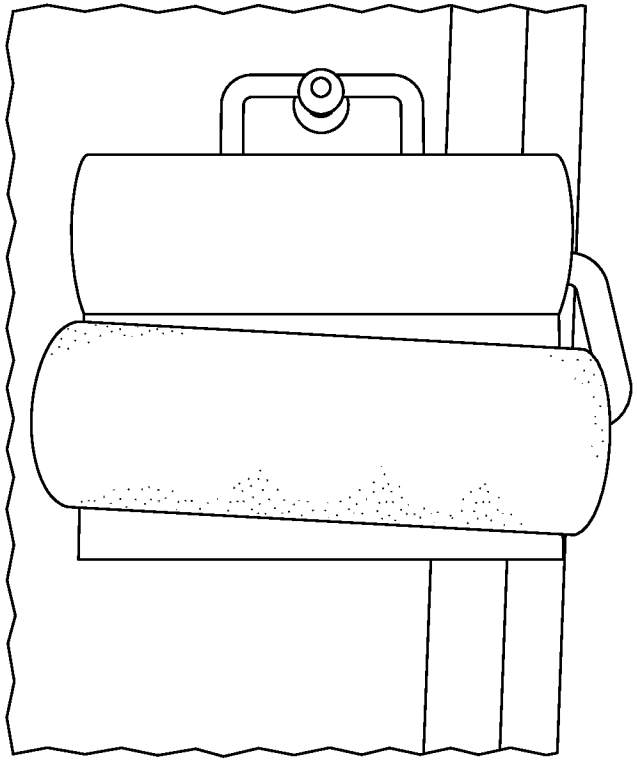
FIG. 9D is another photograph of a dispenser in use according to one or more embodiments shown and described herein.
Figure 9C:
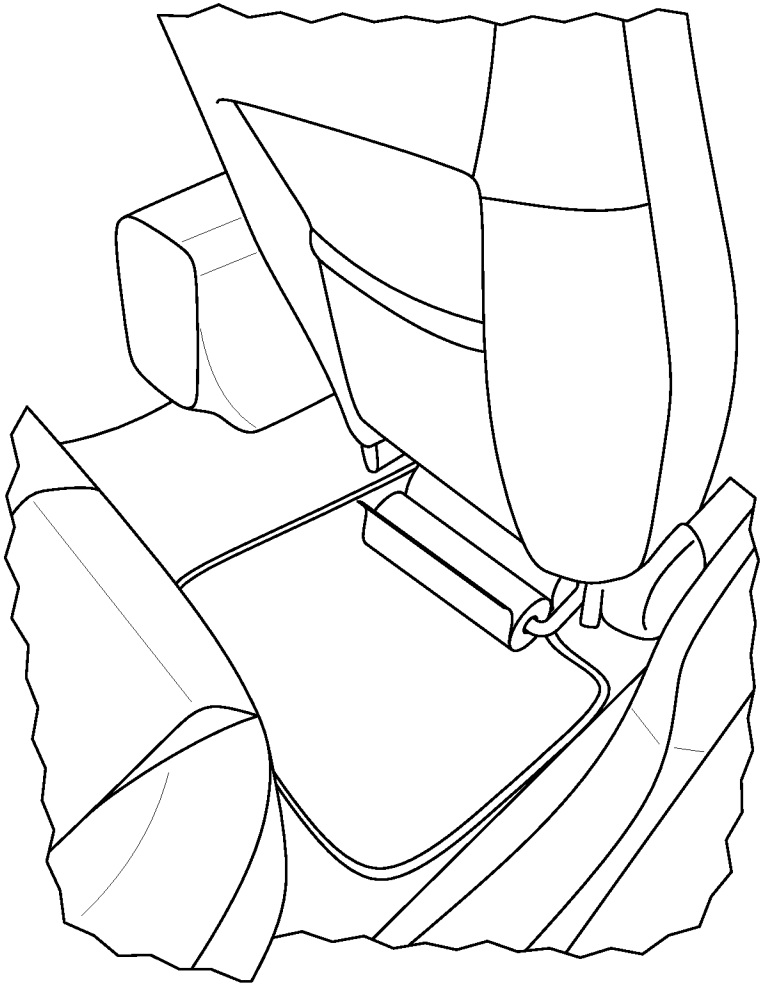
FIG. 9C is another photograph of a dispenser in use according to one or more embodiments shown and described herein.

FIGS. 9A-9D are photographs of the apparatus 10 in use. In particular, FIG. 9A depicts a user dispensing a paper towel from a roll of paper towels affixed to the apparatus 10 while the apparatus 10 is positioned beneath the front seat of a vehicle. FIG. 9B depicts the arrangement of the apparatus 10 within the vehicle, showing the third section of the base being positioned between the floor of the vehicle and the floor mat of the vehicle (lifted in FIG. 9B). FIG. 9C is a photograph showing that the paper towels can also be dispensed by a user in the rear of the vehicle, by pulling the end of the roll of paper towels toward the first section of the base. FIG. 9D is a photograph illustrating the apparatus hanging on a handle for use outside of the vehicle.

Based on the foregoing, it should be appreciated that various embodiments described herein provide a mat that acts as a base for a dispenser of paper and rolled products (including without limitation paper towels, toilet paper, tissues, etc.) as well as methods of using such mats. The various embodiments described herein enable products to be secured within a vehicle, substantially out of view, while remaining accessible. Various embodiments also enable the dispenser to be easily removed from the vehicle and used in a vertical orientation to dispense the product.

Different embodiments or implementations may yield one or more of the following advantages. The third section of the base and affixed dispenser can be sandwiched between the floor and a floor mat to provide anchoring capacity. Additionally, in embodiments, the apparatus can be used horizontally under a seat, laid on a horizontal surface (including but not limited to a trunk, table, seat, etc.) or hung vertically by its handle and still function as a friction- and gravity-based mat and affixed dispenser for dispensable paper and rolled products.

The invention claimed is:

1. An apparatus comprising:

a base having a first section comprising a handle; a second section having a varying thickness along a width of the second section; and a third section, wherein the second section is between the first section and the third section; and an arm pivotally coupled to and received by the second section and rotatable between a first position, in which the arm is positioned proximate the first section of the base, and a second position, in which the arm is positioned proximate the third section of the base;

wherein the second section has a thickness that increases from about 0.125 inch at a first side of the second section to about 1.5 inches at a center point along a width of the second section and decreases to about 0.125 at a second side of the second section.

2. The apparatus according to claim 1, wherein the handle has a circular cross-section.

3. The apparatus according to claim 1, wherein the first section has width of from about 5 to about 8 inches and a length of from about 6 to about 10 inches.

4. The apparatus according to claim 1, wherein the first section has a thickness of from about 0.5 inch to about 1.5 inches.

5. The apparatus according to claim 1, wherein a cross-section of the second section is a semi-circle.

6. The apparatus according to claim 1, wherein the base is made of non-slip materials.

7. The apparatus according to claim 1, wherein the arm pivots around a rotational point at which the arm is coupled to the second section about 180 degrees.

8. The apparatus, according to claim 1, wherein the third section has a thickness of less than about 0.25 inches, a width of from about 2 inches to about 6 inches, and a length of from about 6 inches to about 15 inches.

9. An apparatus comprising:

a base having a first section comprising a handle; a second section having a varying thickness along a width of the second section; and a third section, wherein the second section is between the first section and the third section; and an arm pivotally coupled to and received by the second section and rotatable between a first position, in which the arm is positioned proximate the first section of the base, and a second position, in which the arm is positioned proximate the third section of the base;

wherein the arm pivots around a rotational point at which the arm is coupled to the second section about 180 degrees.

10. The apparatus according to claim 9, wherein the handle has a circular cross-section.

11. The apparatus according to claim 9, wherein a cross-section of the second section is a semi-circle.

12. The apparatus according to claim 9, wherein the base is made of non-slip materials.

13. The apparatus according to claim 9, wherein a maximum thickness of the second section is from about 1.25 inches to about 2.25 inches.

14. An apparatus comprising:

a base having a first section comprising a handle; a second section having a varying thickness along a width of the second section; and a third section, wherein the second section is between the first section and the third section; and an arm pivotally coupled to and received by the second section and rotatable between a first position, in which the arm is positioned proximate the first section of the base, and a second position, in which the arm is positioned proximate the third section of the base;

wherein the third section has a thickness of less than about 0.25 inches, a width of from about 2 inches to about 6 inches, and a length of from about 6 inches to about 15 inches.

15. The apparatus according to claim 14, wherein the handle has a circular cross-section.

16. The apparatus according to claim 14, wherein a cross-section of the second section is a semi-circle.

17. The apparatus according to claim 14, wherein the base is made of non-slip materials.

18. The apparatus according to claim 14, wherein a maximum thickness of the second section is from about 1.25 inches to about 2.25 inches.

* * * * *